US005305681A

United States Patent [19]

Devier et al.

[11] Patent Number: 5,305,681

[45] Date of Patent: Apr. 26, 1994

[54] HYDRAULIC CONTROL APPARATUS

[75] Inventors: Lonnie J. Devier; John J. Krone, both of Dunlap; Michael S. Lukich, Peoria; Stephen V. Lunzman, Chillicothe; Howard A. Marsden, Pekin, all of Ill.

[73] Assignee: Caterpillar Inc., Peoria, Ill.

[21] Appl. No.: 104,521

[22] Filed: Aug. 10, 1993

Related U.S. Application Data

[63] Continuation of Ser. No. 821,099, Jan. 15, 1992.

[51] Int. Cl.[5] ..... F15H 13/16

[52] U.S. Cl. ..... 91/361; 60/427; 60/463; 60/462

[58] Field of Search ..... 60/420, 427, 459, 462, 60/463, 484, 911; 91/1, 358 R, 861, 363 R, 364, 419, 433, 435, 459, 461, D11; 92/5 R; 137/625.65

[56] References Cited

U.S. PATENT DOCUMENTS

| | | | |
|---|---|---|---|
| 3,821,625 | 6/1974 | Scholl | 318/624 |
| 4,164,167 | 8/1979 | Imai et al. | 91/433 X |
| 4,523,892 | 6/1985 | Mitchell et al. | 417/34 |
| 4,531,366 | 7/1985 | Moriya et al. | 60/427 |
| 4,534,707 | 8/1985 | Mitchell | 417/34 |
| 4,643,074 | 2/1987 | Gunda et al. | 91/361 |
| 4,644,749 | 2/1987 | Somes | 60/459 |
| 4,712,376 | 12/1987 | Handank | 60/427 |
| 4,712,470 | 12/1987 | Schmitz | 91/361 |
| 4,718,329 | 1/1988 | Nakajima et al. | 91/445 |
| 4,759,183 | 7/1988 | Kreth et al. | 91/459 X |
| 4,811,561 | 3/1989 | Edwards et al. | 60/420 X |
| 4,884,402 | 12/1989 | Strenzke et al. | 60/465 X |
| 4,970,941 | 11/1990 | Reinhardt | 91/433 |
| 5,012,722 | 5/1991 | McCormick | 137/625.65 X |
| 5,044,608 | 9/1991 | Hidaka et al. | 91/361 |
| 5,074,194 | 12/1991 | Hirata et al. | 60/484 X |
| 5,079,492 | 1/1992 | Takagi | 91/361 X |
| 5,138,838 | 8/1992 | Crosser | 60/427 X |
| 5,230,272 | 7/1993 | Schmitz | 91/361 |

FOREIGN PATENT DOCUMENTS

0235545B1 9/1990 European Pat. Off. .

*Primary Examiner*—Edward K. Look
*Assistant Examiner*—F. Daniel Lopez
*Attorney, Agent, or Firm*—James R. Yee

[57] ABSTRACT

An apparatus for controllably actuating a hydraulic actuator is provided. The apparatus is connected between a source of pressurized hydraulic fluid and the hydraulic actuator. The apparatus controllably provides pressurized hydraulic fluid to the hydraulic actuator. The apparatus includes a controller for receiving an operating signal and a load pressure signal and responsively actuating the hydraulic actuator.

15 Claims, 7 Drawing Sheets

100
102A
102B
102C
104A
104B
104C
106A
106B
106C
108A
108B
108C
110
112A
112B
112C
112D
114A
114B
114C
114D
116A
116B
116C
118A
118B
118C
120
122A
122B
122C
124
126
128
130
VALVE MEANS
VALVE MEANS
VALVE MEANS
CONTROLLER
MODE SWITCH

HYDRAULIC CONTROL APPARATUS

This is a continuation of application Ser. No. 07/821,099, filed Jan. 15, 1992.

DESCRIPTION

1. Technical Field

This invention relates generally to an apparatus for controlling a hydraulic circuit with a plurality of hydraulic actuators and more particularly to an apparatus for controlling the flow characteristics of individual hydraulic actuators.

2. Background Art

Hydraulic drive systems are utilized in construction equipment such as hydraulic excavators, backhoe loaders, and end loaders. Known systems typically use a plurality of open center control valves to controllably actuate the various hydraulic actuators on the vehicle. Normally, such drive systems are controlled through a series of operator control levers which are coupled to the control valves mechanically or hydraulically. The open center control valves give the system a variable response which is dependent on the load on the actuator. In manually operated systems, this may be desirable because the variable response gives the operator an indication of the load on the actuator. The operator then has a better feel for the operation of the vehicle and can better adjust his/her manipulation of the control levers to achieve the desired result.

Recently, however, a lot of effort has gone into automating or semi-automating the functions of such vehicles. In these automatic or semi-automatic systems, the response characteristics of an open center valve is almost always undesirable. Such systems require consistent response to ensure constant and predictable operation. One way to achieve constant and predictable results is to use a pressure compensated closed center valve. Pressure compensated valves use pressure feedback to achieve consistent response. However, the operator loses the sense or "feel" for the load.

It has also been found desirable in such systems to have drive systems which can exhibit both response characteristics. For example, for a system adapted to perform in manual and automatic modes, it may be desirable to have certain hydraulic circuits operating with open center response characteristics in the manual mode and operating with pressure compensated closed center response characteristics in the automatic mode.

The subject invention is directed at overcoming one or more of the problems as set forth above.

DISCLOSURE OF THE INVENTION

In one aspect of the present invention, an apparatus for controlling a hydraulic circuit having a plurality of hydraulic actuators is provided. The apparatus is connected between a source of pressurized hydraulic fluid and the hydraulic actuators. The apparatus produces a mode signal and responsively produces a plurality of command signals. Each command signal corresponds to a respective hydraulic actuator and are determined according to a first set of flow control characteristics responsive to the mode signal having a first value and according to a second set of flow control characteristics responsive to the mode signal having a second value.

BEST MODE FOR CARRYING OUT THE INVENTION

Figure 1:
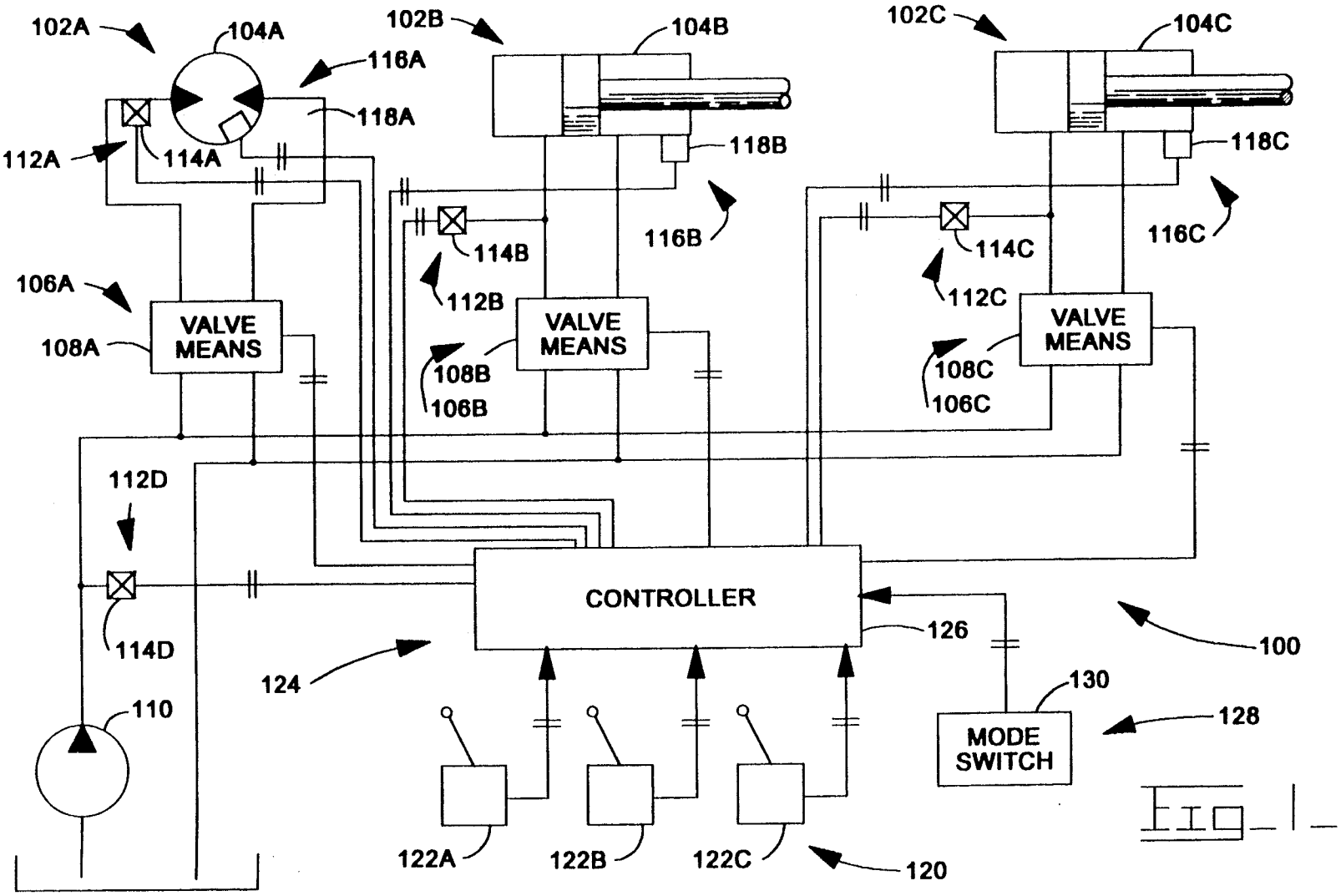
FIG. 1 is a stylized representation of a hydraulic circuit with a plurality of hydraulic actuators and a controlling means, according to an embodiment of the present invention.

With reference to FIG. 1, the present invention or apparatus 100 is adapted to control a hydraulic circuit having a plurality of hydraulic actuators 102A,102B,102C, as shown. The hydraulic circuit shown includes: a rotary motor 104A and two linear actuators or cylinders 104B,104C. However, the circuit could include any number and/or types of actuators. The apparatus 100 further includes first, second and third valve means 106A,106B,106C for providing pressurized hydraulic fluid to the respective actuators 102A,102B,102C.

The first, second, and third valve means 106A,106B,106C each include at least one respective valve 108A,108B,108C.

A means 128 produces a mode signal. The mode producing means 128 is actuated by an operator and determines the mode of operation of the apparatus 100.

A means 120 produces a plurality of operating signals responsive to an operator. In the preferred embodiment, the operating signal producing means 120 includes a plurality of operator control levers 122 corresponding to respective hydraulic actuators 102.

Figure 2:
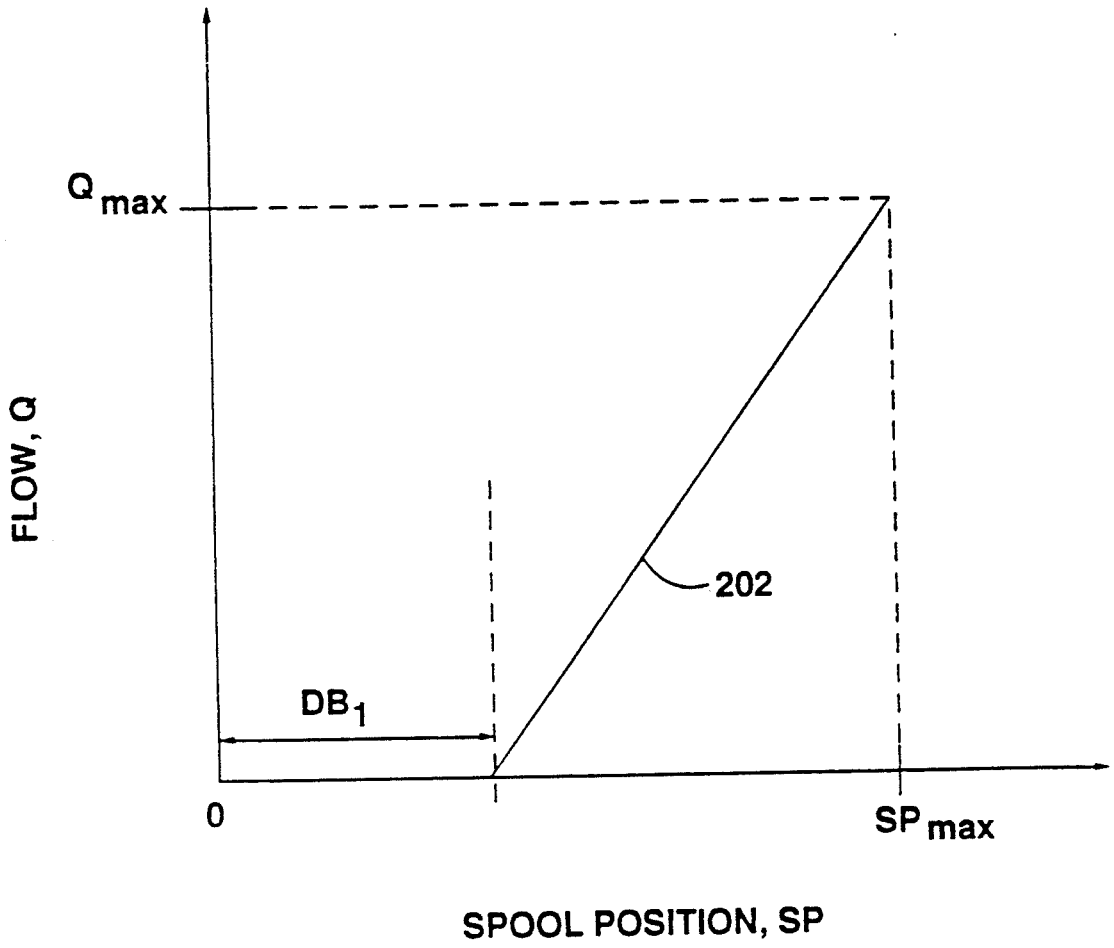
FIG. 2 is a graph illustrating the flow of hydraulic fluid to the hydraulic actuators of FIG. 1 under a first set of flow characteristics, according to an embodiment of the present invention.
Figure 3:
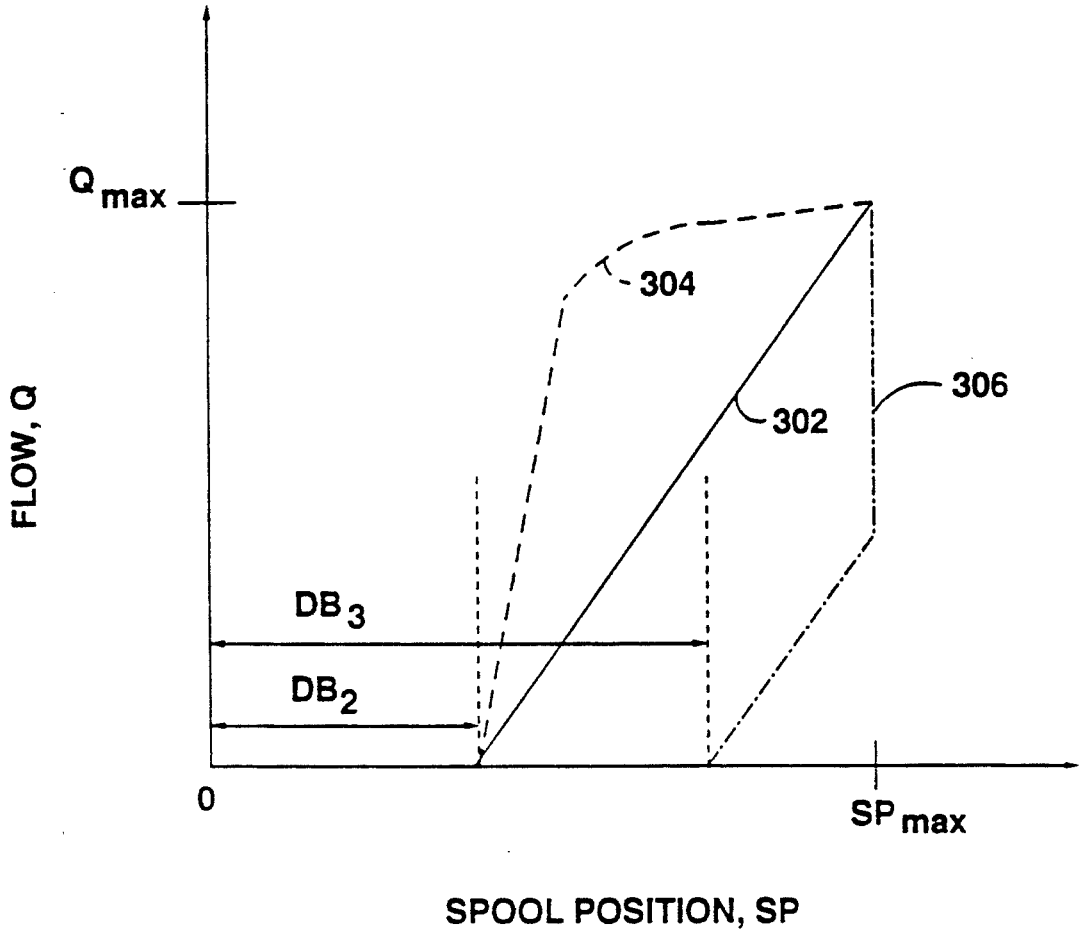
FIG. 3 is a graph illustrating the flow of hydraulic fluid to the hydraulic actuators of FIG. 1 under a second set of flow characteristics, according to an embodiment of the present invention.

A controlling means 124 receives the mode signal and responsively controls the operation of the first, second, and third valve means 106A,106B,106C according to a first or second set of flow characteristics. In the preferred embodiment, the first set of flow characteristics are generally similar to the flow characteristics of a closed center pressure compensated valve. That is, the flow of hydraulic fluid through the valve is a function of the valve's spool position and does not vary with the load. The flow characteristics of a closed center valve are illustrated by the graph of FIG. 2. The graph also features a constant deadband, $DB_1$. For simplicity, the flow characteristics from the deadband to maximum spool position are shown as being linear. However, the flow response is a function of the construction of the valve (for example, the metering slot areas). In the preferred embodiment, the second set of flow characteristics are generally similar to the flow characteristics of an open center valve, as shown in FIG. 3. That is, the flow of hydraulic fluid through the valve 108 is a function of the valve spool position and the load on the respective actuator 102.

The traces of FIG. 3 illustrate the response of the valve or the flow of fluid to the actuator 101 as a function of the spool position. For example, the circuit is designed for a rated load. The response of the circuit under the rated or designed load is illustrated by a design load trace 302. The circuit exhibits a deadband, or range of spool positions for which there is no fluid flow to the actuator 102. The deadband for the rated load is designated by $DB_2$. For the rated load, the flow of fluid to the actuator for the rest of the range of spool positions is proportional to the spool position and is a function of the metering slot area. For simplicity, the flow is shown as linear, but the present invention is not limited to such. Load trace 304 illustrates the response of the valve under a load less than the design load. Load trace 306 illustrates the response of the valve under a load greater than the design load.

A means 112 senses hydraulic pressures within the hydraulic circuit. The sensing means 112 includes means 112A, 112B, 112C for sensing the load pressure of each hydraulic actuator 102A,102B,102C. In the preferred embodiment, the sensing means includes a means 112D for sensing the pump pressure. Each pressure sensing means 112 includes a pressure sensor 114.

A means 116 senses a position of each hydraulic actuator 102A,102B,102C. The sensing means 116 preferably includes means for sensing the velocity and/or acceleration of the hydraulic actuators 102A,102B,102C.

The means 116 senses the actual position of the actuator 102 and produces a signal, $p_a(t)$. In one embodiment, the means 116 includes a radio frequency (RF) linear position sensor, as disclosed in U.S. Pat. No. 4,737,705, issued Apr. 12, 1988 to Bitar, et al. In another embodiment, the means 116 includes a potentiometer based sensor (not shown). And in a third embodiment, the means 116 includes a resolver (not shown). Use of both the resolver and the potentiometer based sensors are well known in the art and are therefore not further discussed.

The means 116 senses the actual velocity of the actuator 102 and produces a signal, $v_a(t)$. In one embodiment, the means 116 includes a velocity sensor (not shown). The velocity sensor includes a DC generator which when rotated, generates a voltage indicative of the velocity of rotation (and therefore the linear velocity of the actuator 102). In a second embodiment, the means 116 determines the velocity of the piston 202 by numerically filtering and differentiating the position signal, $p_a(t)$.

The controlling means 124 receives mode signal and responsively producing a plurality of command signals. Each command signal corresponding to a respective hydraulic actuator 102A,102B,102C. The command signals are determined according to a first set of flow control characteristics responsive to said mode signal having a first value and according to a second set of flow control characteristics responsive to said mode signal having a second value. For example, in a specific mode, as identified by the mode signal, it may be desirable to operate a specific valve with the flow characteristics of a closed center valve and it may be desirable to operate the same valve with the flow characteristics of an open center valve. The apparatus, is adapted to controllably operate the valve means 106 under either the flow characteristics of a closed center valve or the flow characteristics of an open center valve.

Figure 4:
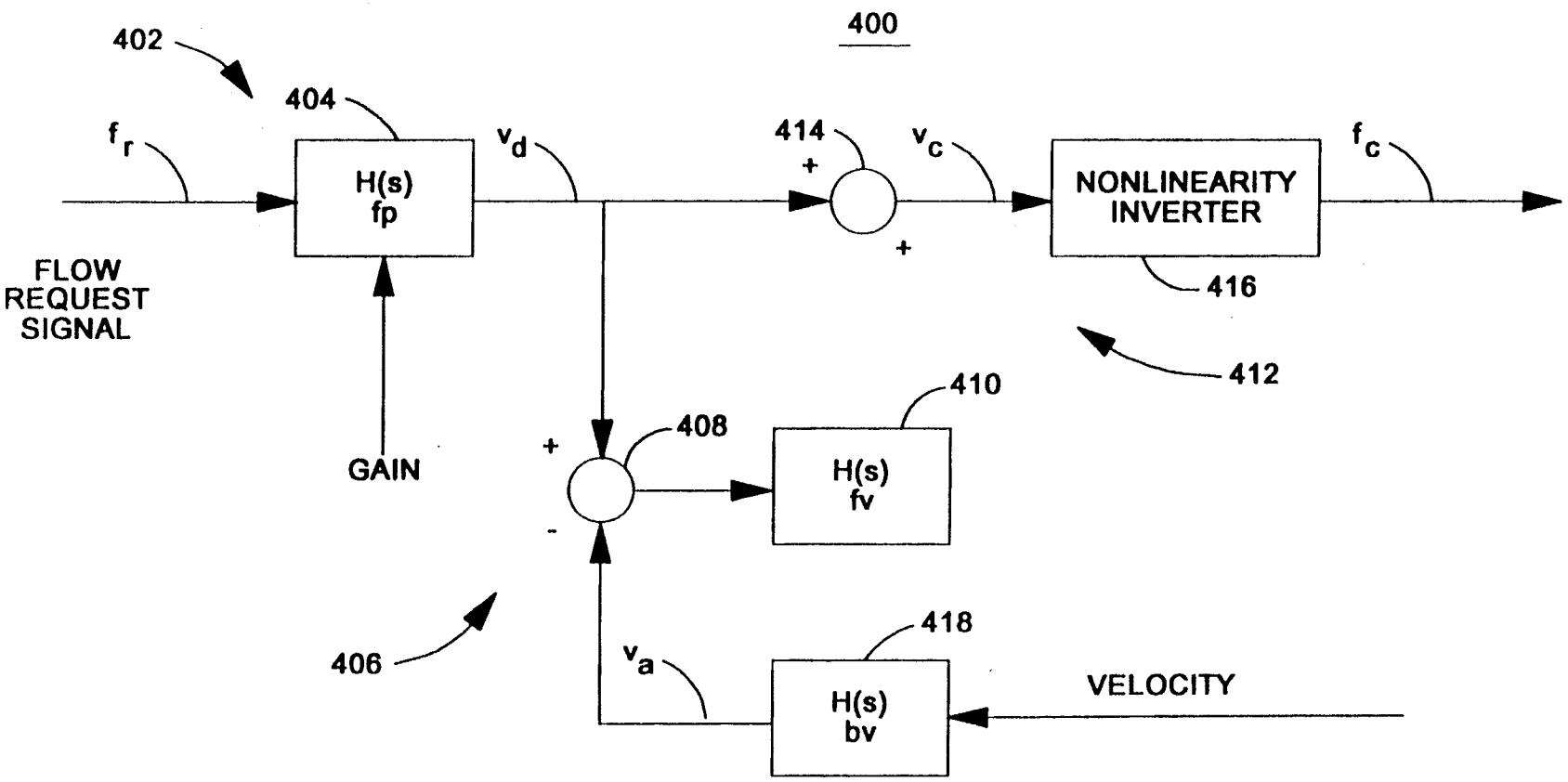
FIG. 4 is a block diagram of a first control scheme implementing the first set of flow characteristics of FIG. 2 for an open center valve, according to an embodiment of the present invention.
Figure 5:
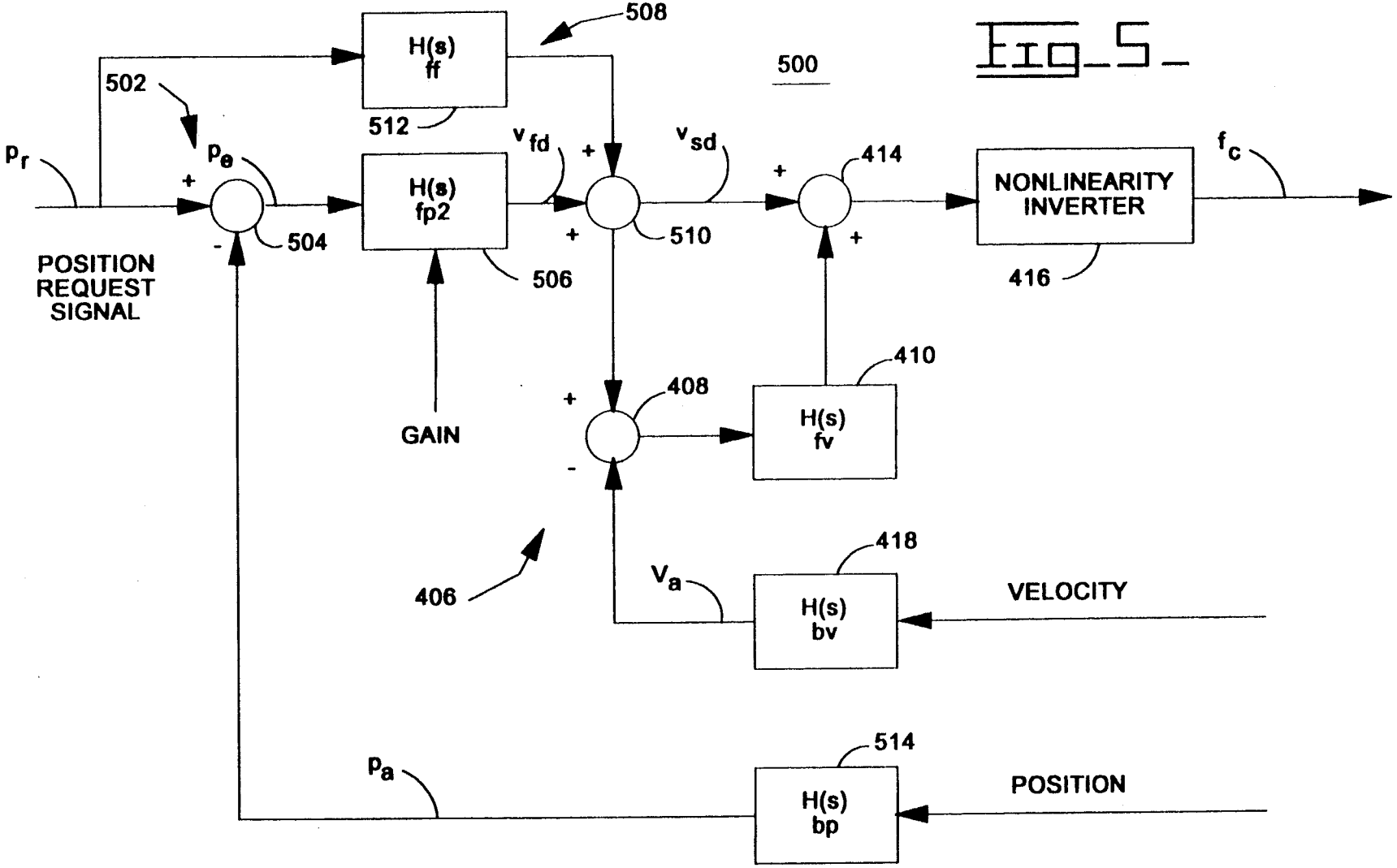
FIG. 5 is a block diagram of a second control scheme implementing the first set of flow characteristics of FIG. 2 for an open center valve, according to another embodiment of the present invention.

With reference to FIGS. 4 and 5, if the valve means 108 includes an open center valve, then the controller 126 compensates to achieve the flow characteristics of a closed center valve. The controller 124 processes the acquired velocity and position signals, $v_a$,$p_a(t)$, produces a compensated velocity signal, $v_c(t)$, and a flow command signal, $f_c(t)$. The flow command signal, $f_c(t)$, is indicative of the desired flow of hydraulic fluid to the hydraulic cylinder 204 and is preferably proportional to the compensated velocity signal, $v_c(t)$.

The valve means 106 receives the flow command signal, $f_c(t)$, and produces a pilot pressure signal, $p_p(t)$. In one embodiment, the valve means 106 includes an electrohydraulic pilot system (not shown). The pilot system 226 includes a proportional pilot pressure solenoid valve. The flow command signal, $f_c(t)$, actuates the solenoid valve, which in turn, delivers pilot pressure signals, $p_p(t)$, to the directional valve 108. The pilot pressure signals, $p_p(t)$, are in the form of hydraulic fluid under low pressure (typically, below 1000 psi). The hydraulic fluid acts on the valve's spool to actuate the directional valve 108. Pilot systems are well known in the art and are therefore not further discussed.

The controller 124 receives the position signal, $p_a(t)$, from the sensing means 116 and produces a flow command signal. In one embodiment, the controller 124 also receives the velocity signal, $v_a(t)$, from the velocity sensor. In a second embodiment, the controller 124 computes the velocity of the piston 202 by numerically filtering and differentiating the position signal, $p_a(t)$. In a third embodiment, the controller 124 also receives a signal indicative of the acceleration of the actuator 101 from the sensing means 116. The controller 124 receives a request signal or signals from one or more sensors 218,220 and produces the flow command signal, $f_c(t)$. In a first embodiment, the controller 124 receives the actual velocity signal, $v_a(t)$, and produces the flow command signal, $f_c(t)$, in accordance with a first control scheme 400, as shown in FIGS. 4, 5A, and 5B. In the first embodiment, the controller 124 receives a flow request signal, $f_r(t)$, which is indicative of the desired velocity and is typically proportional to the displacement of an operator actuated control handle 122. The velocity signal, $v_a(t)$, represents the actual velocity of the actuator 102.

A means 402 receives the flow request signal, $f_r(t)$ and produces a desired velocity signal, $v_d(t)$. In the preferred embodiment, the means 402 implements a first transfer function, $h_{fp}(t)$ 404. The first transfer function, $h_{fp}(t)$ 404 scales the flow request signal, $f_r(t)$ to produce the desired velocity signal, $v_d(t)$.

The La Place transform of the first transfer function, $h_{fp}(t)$ 404 is denoted as $H_{fp}(s)$ and is of the form:

$$H_{fp}(s)=K_1.$$

Therefore, $$V_d(s)=K_1\times F_r(s),$$

where $K_1$ is a constant, $V_d(s)$ is the La Place transform of the desired velocity signal and $F_r(s)$ is the La Place transform of the flow request signal.

A means 406 subtracts the actual velocity signal, $v_a(t)$, from the desired velocity signal, $v_d(t)$, and produces a velocity error signal, $v_e(t)$. In the preferred embodiment, the means 406 includes a first summing junction 408 and implements a second transfer function, $h_{fv}(t)$ 410. The second transfer function, $h_{fv}(t)$ 410 provides velocity feedback compensation and, in the preferred embodiment, scales and integrates the output of the first summing junction 408 to produce the velocity error signal, $v_e(t)$.

The La Place transform of the second transform function, $h_{fv}(t)$ is denoted as $H_{fv}(s)$ and is of the form:

$$H_{fv}(s)=K_2/s,$$

where $K_2$ is a constant.
Therefore, $$\begin{aligned} V_e(s) &= H_{fv}(s)\times(V_d(s)-V_a(s)) \\ &= K_2\times(V_d(s)-V_a(s))/s, \end{aligned}$$

where $V_e(s)$ and $V_a(s)$ represent the La Place transforms of the velocity error signal and the actual velocity signal, respectively.

A means 412 receives the desired velocity signal, $v_d(t)$, and the velocity error signal, $v_e(t)$, and produces the flow command signal, $f_c(t)$. In the preferred embodiment, the flow command signal, $f_c(t)$, is a pulse width modulated (PWM) drive current applied to the solenoid of the pilot system 226. The flow command signal, $f_c(t)$, actuates the solenoid. The means 412 includes a second summing junction 414 and a nonlinearity inverter 416. The second summing junction 414 adds the desired velocity signal, $v_d(t)$ and the velocity error signal, $v_e(t)$ to produce the compensated velocity signal, $v_c(t)$. The nonlinearity inverter 416 receives the compensated velocity signal, $v_c(t)$, and produces the flow command signal, $f_c(t)$.

The nonlinearity inverter 416 compensates for the nonlinearities of the directional valve 208 and in the preferred embodiment includes a map in the controller 222. The steady-state characteristics, particularly, the deadband and flow gain characteristics, are measured and are stored in the map. The nonlinearity inverter 416 receives the compensated velocity signal and uses the map to determine the appropriate flow command signal, $f_c(t)$.

The velocity sensing means 216 includes a third transfer function, $H_{bv}(s)$ 418. The third transfer function, $H_{bv}(s)$ 418, mitigates sensor noise by filtering the output of the velocity sensor 220 to produce the actual velocity signal, $v_a(t)$. In the preferred embodiment, the third transfer function 418 is a second order filter with a corner frequency around 10 Hz.

The La Place transform of the third transfer function is denoted as $H_{bv}(s)$ and is of the form:

$$K_3/\{s^2+(K_4\times s)+K_3\},$$

where $K_3$ and $K_4$ are constants.

In a second embodiment, the controller 124 receives the actual velocity signal, $v_a(t)$, and the actual position signal, $p_a(t)$, and produces the flow command signal, $f_c(t)$, in accordance with a second control scheme 500, as shown in FIG. 5. In the second embodiment, the controller 124 is responsive to a position request signal, $p_r(t)$, which is indicative of a desired position of the actuator 102.

A means 502 receives the position request signal, $p_r(t)$ and the actual position signal, $p_a(t)$, and produces a first desired velocity signal, $v_{fd}(t)$. The first desired velocity signal producing means 502 includes a third summing junction 504 and implements a fourth transfer function, $H_{fp2}(t)$. The third summing junction 504 subtracts the actual position signal, $p_a(t)$ from the position request signal, $p_r(t)$, and produces a position error signal, $p_e(t)$. The fourth transfer function, $h_{fp2}(t)$ 506 scales the position error signal, $p_e(t)$ to produce the first desired velocity signal, $v_{fd}(t)$. In an alternate embodiment, the fourth transfer function 506 also filters the position error signal, $p_e(t)$.

The La Place transform of the fourth transfer function, $h_{fp2}(t)$ 506 is denoted as $H_{fp2}(s)$ and is of the form:

$$H_{fp2}(s)=K_5.$$

Therefore, $$V_{fd}(s)=K_5\times P_e(s),$$

where $K_5$ is a constant, $V_{fd}(s)$ is the La Place transform of the first desired velocity signal and $P_e(s)$ is the La Place transform of the position error signal.

A means 508 provides feed forward compensation. The feed forward compensation providing means 508 includes a fourth summing junction 510 and implements a fifth transfer function, $H_{ff}(s)$ 512. The fifth transfer function, $H_{ff}(s)$ 512, scales and differentiates the position request signal, $p_r(t)$. The fourth transfer function 506, $H_{fp2}(s)$ may have some inherent phase lag, particularly at low frequencies. The fifth transfer function 512 provides phase lead to improve system response and to compensate for the phase lag of the fourth transfer function 512.

The fourth summing junction 510 adds the output of the fifth transfer function 512 to the first desired velocity signal, $v_{fd}(t)$, to produce a second desired velocity signal, $v_{sd}(t)$.

The La Place transform of the fifth transfer function, $h_{ff}(t)$ 512 is denoted as $H_{ff}(s)$ and is of the form:

$$H_{ff}(s)=s\times K_6,$$

where $K_6$ is a constant.
Therefore, $$\begin{aligned} V_{sd}(s) &= H_{ff}(s)\times P_r(s)+V_{fd}(s) \\ &= s\times P_r(s)\times K_6+V_{fd}(s), \end{aligned}$$

where $V_{sd}(s)$ represents the La Place transfer function of the second desired velocity signal.

The position sensing means 515 includes a sixth transfer function 514, $H_{bp}(s)$. The sixth transfer function 514, $H_{bp}(s)$, mitigates sensor noise by filtering the output of the position sensor 118 to produce the actual position signal, $p_a(t)$. In the preferred embodiment, the sixth transfer function 514 is a second order polynomial with a corner frequency around 10 Hz (similar to the third transfer function 424).

The second desired velocity signal, $v_{sd}(t)$ is processed, similarly to the desired velocity signal, $v_d(t)$ in the first control scheme 400, to produce the flow command signal, $f_c(t)$.

Figure 6A:
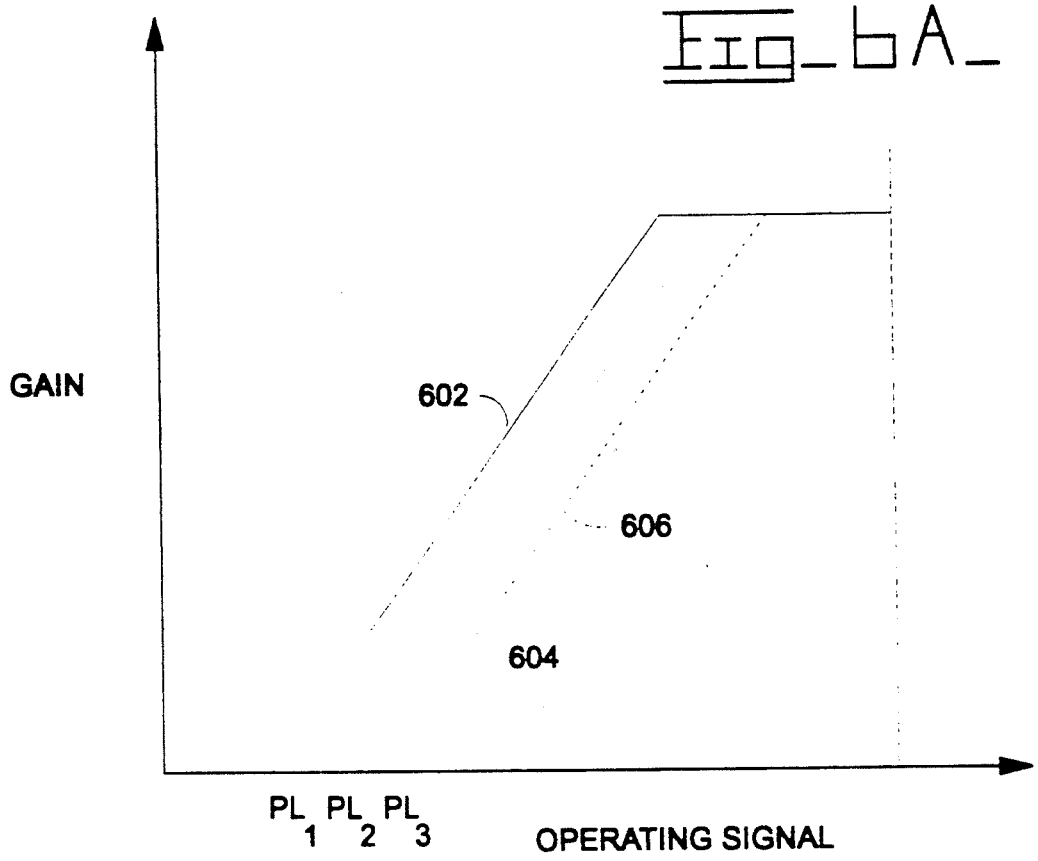
FIG. 6A is a graph of load dependent gain curves for use by the controlling means of FIG. 1 in implementing the second set of flow characteristics of FIG. 3 for a closed center valve, according to an embodiment of the present invention.
Figure 6B:
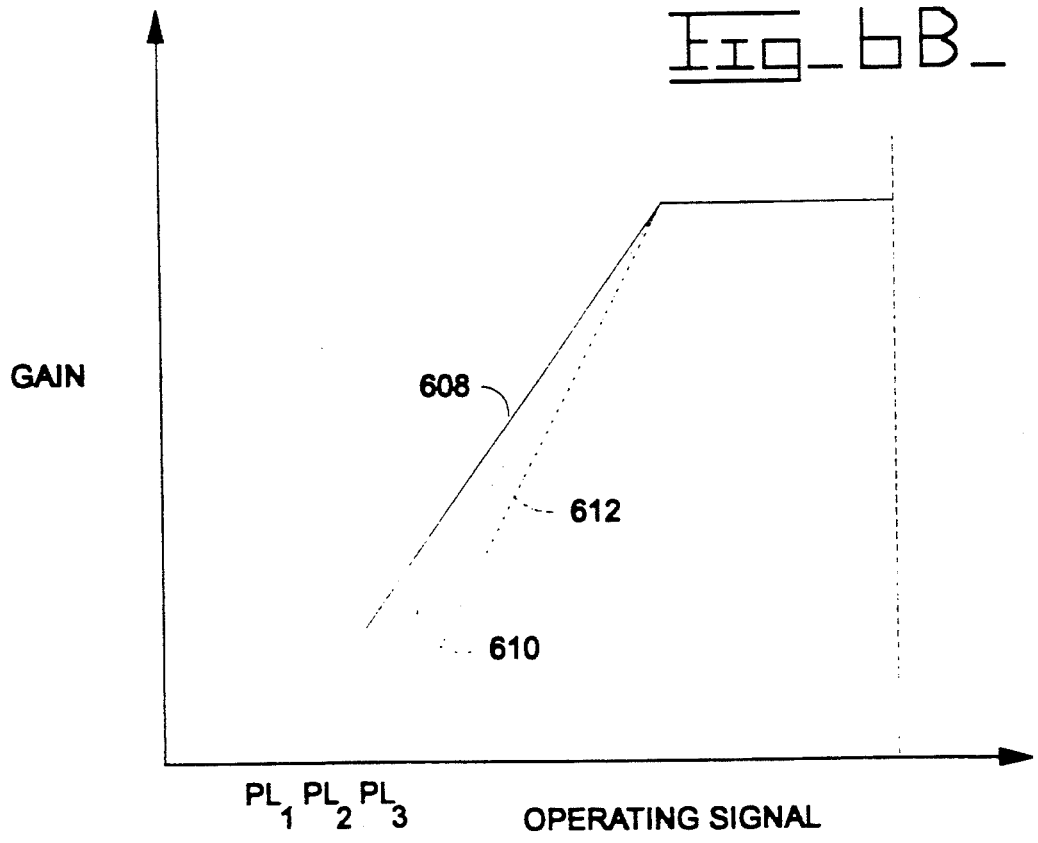
FIG. 6B is a graph of load dependent gain curves for use by the controlling means of FIG. 1 in implementing the second set of flow characteristics of FIG. 3 for a closed center valve, according to another embodiment of the present invention; and, FIG. 7A is a stylized representation of a non pressure compensated valve.
Figure 7A:
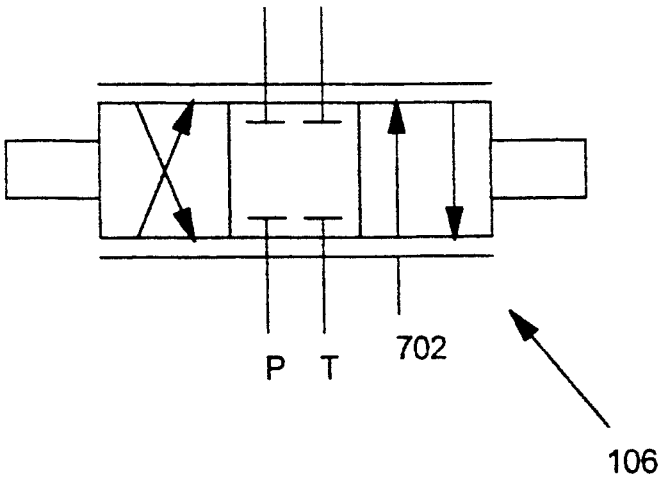
FIG. 7B is a stylized representation of a pressure compensated valve.
Figure 7B:
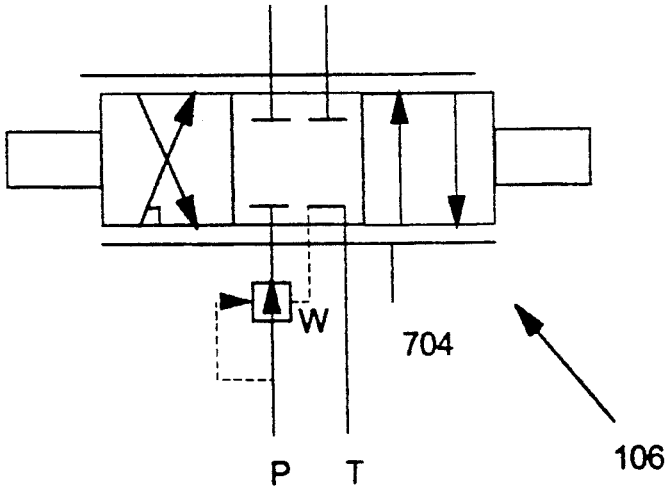

With reference to FIGS. 6A and 6B, if the valve means 108 includes a closed center valve, the controller 126 compensates to achieve the flow response of an open center valve. To operate the closed center valve as an open center valve, the controlling means 124 receives the load pressure signal, the operating signal and the mode signal and responsively produces a command signal. The command signal actuates the valve 108 and thereby controls the flow of fluid to the hydraulic actuator 102 by moving the valve's spool. The valve 108 adapted such that the hydraulic fluid flow is linearly proportional to the command signal.

If the mode indicating means 128 indicates that the valve is to be operated with the response characteristics of a nonpressure compensated valve, then the controller 124 receives the load pressure signal and responsively determines a gain signal. The command signal is then determined as a function of the gain signal and the operating signal.

If the mode indicating means 128 indicates that the valve is to be operated with the response characteristics of a pressure compensated valve, then the command signal is linearly proportional to the operating signal and is independent of the load signal.

With reference to FIGS. 6A and 6B, in the preferred embodiment, the controller 124 stores a plurality of gain curves. The gain curves of FIGS. 6A and 6B are modeled on the desired response shown in FIG. 3. The gain curves shown are used to operate a pressure compensated control valve with the flow response characteristics of non pressure compensated valves. Gain curves to operate a non pressure compensated valve as pressure compensated are modeled on FIG. 2, wherein flow is independent of the load. For simplicity three gain curves are shown, but the present invention is not limited to any number. Each gain curve is associated with a predetermined load. The controller 124 is adapted to select a curve as a function of the load sensed by the pressure sensing means 112. Using the selected curve, the controller 126 determines a gain as a function of the operating signal. The gain and the operating signal are then used to determine the command signal. The controller 126 may be further adapted to interpolate or extrapolate between curves to achieve a more precise gain.

The gain curves are constructed such that as the load on the actuator 102 varies, a different gain curve is selected. In one embodiment, the gain curves are linear. For example, as shown in FIG. 6A, the three gain curves 602,604,606 are linear and have the same slope. In another example, as shown by the three gain curves 608,610,612 in FIG. 6B, the gain curves may be linear with different slopes. Preferably, the gain curves are adapted such that the gain reaches a maximum value for a given operating signal or lever position for all loads. In FIGS. 6A and 6B, each curve corresponds to a given load; labeled: $PL_1$, $PL_2$, and $PL_3$, respectively. The three loads have the relationship:

$$PL_1 \leqq PL_2 \leqq PL_3.$$

For a given control lever position and operating signal, the gain signal is inversely proportional to the load. That is $$G_1 \geqq G_2 \geqq G_3,$$

where $G_1$, $G_2$ and $G_3$ are the respective gain signals.

Industrial Applicability

With reference to the drawings and in operation, the present invention or apparatus 100, is adapted to controllably actuate a hydraulic circuit with a plurality of valve means 106. Preferably, each valve means 106 includes an open center valve. The apparatus 100 controllably actuates each valve according to a set of flow characteristics based on a mode signal. While, open center valves are preferable because of lower cost, the present invention may be adapted to controllably actuate a plurality of closed center valves.

An operator identifies a desired mode of operation through a mode indicating means 128. The controller 126 then receives information from the sensors 114,118 and responsively controls the valve means 106. For example, the operator may indicate operation in an automatic or semi-automatic mode. In either type of mode, it may be desirable to operate the valve means using the flow characteristics of a closed center valve. If the operator through the mode indicating means 128 signals the controlling means 126 that a manual mode is desired, is may be desirable to operate the valve means using the flow characteristics of an open center valve. In other modes, it may be desirable to have some valves operating with one set of characteristics and one or more valves means operating with the second set of characteristics. For example, in a pipe laying application using a hydraulic excavator, it may be desirable to operate the boom hydraulic circuit using the flow characteristics of an open center valve and the stick and work tool hydraulic circuits with the flow characteristics of closed center valve. This allows the operator to retain the sense or "feel" of the load through the boom circuit, while retaining the position accuracy to position the pipe with the stick and work tool circuits.

Other aspect, objects, and features of the present invention can be obtained from a study of the drawings, the disclosure, and the appended claims.

We claim:

1. An apparatus for controlling a hydraulic circuit having a plurality of hydraulic actuators, each hydraulic actuator having first and second ends, the apparatus being connected between a source of pressurized hydraulic fluid and the hydraulic actuators, comprising:

means for controllably providing pressurized hydraulic fluid to the hydraulic actuators, wherein said providing means includes a plurality of respective control valves, each control valve being connected to both the first and second ends of the corresponding hydraulic actuator, wherein each of said control valves includes a signal control element for controlling flow to both the first and second ends of the corresponding hydraulic actuator, wherein said plurality of control valves includes at least one open center control valve and at least one closed center pressure compensated control valve;

means for producing a mode signal;

controlling means for receiving said mode signal and responsively producing a plurality of command signals, each command signal corresponding to a respective hydraulic actuator, wherein said command signal corresponding to said at least one open center control valve is determined according to a set of flow characteristics responsive to said mode signal having a first value and according to a second set of flow characteristics responsive to said mode signal having a second value and wherein said command signal corresponding to said at least one closed center pressure compensated valve is determined according to a third set of flow control characteristics responsive to said mode signal having said first value and according to a fourth set of flow control characteristics responsive to said mode signal having said second value.

2. An apparatus, as set forth in claim 1, wherein said operating signal producing means includes an operator control lever.

3. An apparatus, as set forth in claim 1, including means for sensing hydraulic pressures within said hydraulic circuit.

4. An apparatus, as set forth in claim 3, wherein said hydraulic pressure sensing means includes means for sensing the load pressure of each hydraulic actuator.

5. An apparatus, as set forth in claim 4, wherein said controlling means includes means for determining a gain signal as a function of said load pressure signal and wherein said command signal is a function of said operating signal and said gain signal.

6. An apparatus, as set forth in claim 5, wherein said controlling means includes a plurality of selectable gain curves.

7. An apparatus, as set forth in claim 6, wherein said controlling means includes means for interpolating or extrapolating between curves.

8. An apparatus, as set forth in claim 6, wherein said gain curves are linear.

9. An apparatus, as set forth in claim 8, wherein said linear gain curves have the same slope.

10. An apparatus, as set forth in claim 8, wherein said gain curves have different slopes and reach a maximum value at a predetermined operating signal value.

11. An apparatus, as set forth in claim 3, wherein said hydraulic pressure sensing means includes means for sensing the pump pressure.

12. An apparatus, as set forth in claim 1, includes means for sensing a position of said hydraulic actuators.

13. An apparatus, as set forth in claim 12, wherein said sensing means includes means for sensing the velocity of said hydraulic actuators.

14. An apparatus, as set forth in claim 1, wherein said apparatus is adapted to controllably actuate said at least one providing means in response to a flow request signal.

15. An apparatus, as set forth in claim 1, including:

means for sensing the velocity of the hydraulic actuator corresponding to said at least one providing means and responsively producing an actual velocity signal indicative of said sensed velocity;

means for receiving said flow request signal and responsively producing a desired velocity signal;

means for receiving said actual velocity signal and said desired velocity signal and responsively producing a velocity error signal;

means for receiving said desired velocity signal and said velocity error signal, and producing a flow command signal as a function of said desired velocity signal and said velocity error signal; and, wherein said apparatus is adapted to controllably actuate said at least one providing means in response to a flow request signal.

* * * * *